US006173655B1

(12) United States Patent
Hawthorne

(10) Patent No.: US 6,173,655 B1
(45) **Date of Patent: *Jan. 16, 2001**

(54) SIDE FRAME-BOLSTER INTERFACE FOR RAILCAR TRUCK ASSEMBLY

(75) Inventor: V. Terrey Hawthorne, Lisle, IL (US)

(73) Assignee: AMSTED Industries Incorporated, Chicago, IL (US)

( * ) Notice: Under 35 U.S.C. 154(b), the term of this patent shall be extended for 0 days.

This patent is subject to a terminal disclaimer.

(21) Appl. No.: 09/136,911

(22) Filed: Aug. 20, 1998

(51) Int. Cl.[7] ..... B61F 3/00

(52) U.S. Cl. ..... 105/182.1; 105/207

(58) Field of Search ..... 105/182.1, 200, 105/206.1, 207; 213/11

(56) References Cited

U.S. PATENT DOCUMENTS

| | | | |
|---|---|---|---|
| 2,192,171 | 3/1940 | Akitt | 105/207 |
| 2,199,360 | 4/1940 | Light | 105/207 |
| 2,200,571 | 5/1940 | Barrows | 105/207 |
| 2,220,218 | 11/1940 | Cottrell | 105/207 |
| 2,378,415 | 6/1945 | Light | 105/197 |
| 2,407,950 | 9/1946 | Cottrell | 105/197 |
| 2,422,201 | 6/1947 | Lehrman | 105/197 |
| 2,597,909 | 5/1952 | Tack | 105/197 |
| 2,709,971 | 6/1955 | Rossell | 105/197 |
| 2,911,923 | 11/1959 | Bachman et al. | 105/198.2 |
| 3,339,498 | 9/1967 | Weber | 105/207 |

(List continued on next page.)

FOREIGN PATENT DOCUMENTS

WO 92 20558 11/1992 (WO) ..... B61F/5/12

OTHER PUBLICATIONS

ASME Paper 79–WA/RT–14, "Truck Hunting in Three–Piece Freight Car Truck".
Association of America Railroad Standard S–318–78, p. D–119 in the Manual of Standards and Recommended Practices.
Manual of Standards and Recommended Practices of the Association of America Railroads, p. D–II–200.25.
"Final Report Testing, Evaluation and Recommendations Curving Performance of 125T DS Cars" by Rail Sciences, Inc., Atlanta, Georgia, Feb. 12, 1993.
U.S. Patent Appln. No. 08/850,178; Filed on May 2, 1997; identified as AMSTED Case No. 6159; pp. 1–19; including FIGS. 1–17.

*Primary Examiner*—S. Joseph Morano
*Assistant Examiner*—Robert J. McCarry, Jr.
(74) *Attorney, Agent, or Firm*—Edward J. Brosius; F. S. Gregorczyk; Stephen J. Manich

(57) ABSTRACT

An interface between the end of a bolster and a side frame column for a three-piece railcar truck assembly is disclosed. The bolster and side frame have several pairs of facing stop surfaces at the interface. Each pair of facing stop surfaces are at two different spacings: one spacing is close, with a small gap between the stop surfaces; another spacing is greater than the first. The second spacing allows the side frame to pitch with respect to the bolster transverse axis. The bolster stop surfaces may be the lands inboard and outboard of the friction shoe pockets. The lands may be shaped so that there is a raised warp control portion or surface and one or more relief portions or surfaces, the warp control portion extending farther laterally than the relief portions. The warp control portion is used to maintain the truck in a square relationship, and the more loosely spaced relief portions allow for side frame articulation as the truck traverses track at different elevations. The raised warp control portions and reliefs may alternatively or also be formed on the side frame lands or wear plates.

28 Claims, 10 Drawing Sheets

U.S. PATENT DOCUMENTS

| | | | |
|---|---|---|---|
| 3,408,955 | 11/1968 | Barber | 105/197 |
| 3,901,163 | 8/1975 | Neumann | 105/197 DB |
| 4,084,513 | 4/1978 | Bullock | 105/197 DB |
| 4,276,833 | 7/1981 | Bullock | 105/197 DB |
| 4,357,880 | 11/1982 | Weber | 105/206 R |
| 4,370,933 | 2/1983 | Mulcahy | 105/197 DB |
| 4,440,095 | 4/1984 | Mathieu | 105/207 |
| 4,491,075 | 1/1985 | Neumann | 105/207 |
| 5,072,673 | 12/1991 | Lienard | 105/198.2 |
| 5,331,902 | 7/1994 | Hawthorne et al. | 105/198.2 |
| 5,417,163 | 5/1995 | Lienard | 105/198.7 |
| 5,921,186 * | 7/1999 | Hawthorne et al. | 105/207 |

* cited by examiner

SIDE FRAME-BOLSTER INTERFACE FOR RAILCAR TRUCK ASSEMBLY

BACKGROUND OF THE INVENTION

The present invention relates to railcar truck assemblies and more specifically to an arrangement of the lands or stop surfaces between the side frames and bolster of a three-piece railcar truck assembly.

In previous railcar truck assemblies, wide laterally-extending stop surfaces or lands adjacent to the side frame wear plates and bolster friction shoe pockets have been provided to avoid rotation of the bolster about is longitudinal axis, that is, bolster rotation. Bolster antirotation stops or lugs have also been provided at the inside face of a side frame column to inhibit rotation of the bolster in the side frame about the bolster's longitudinal axis.

Railcar truck hunting is a continuous instability of a railcar wheel set wherein the truck weaves down the track in an oscillatory fashion, usually with the wheel flanges striking against the rail. A related condition known as lozenging is an unsquare condition of the side frames and bolster, and it occurs where the side frames operationally remain parallel to each other, but one side frame moves slightly ahead of the other in a cyclic fashion; this condition is also referred to as parallelogramming or warping. In truck warping, the bolster rotates about its central vertical axis, causing angular displacement of the side frame and bolster longitudinal axes from a normal relationship. Warping results in wheel misalignment with respect to the track. It is more pronounced on curved track and usually provides the opportunity for a large angle-of-attack to occur.

At the same time, the track which the railcar truck assembly traverses may change elevation. It is necessary that the side frame be able to articulate with respect to the bolster. Otherwise, as track irregularities are encountered, the side frame will tend to twist the bolster and produce substantial stresses therein. To avoid these excessive stresses, the side frame needs to be able to pitch, that is, to change its angle with respect to the bolster transverse axes.

To reduce truck warping, U.S. patent application Ser. No. 08/950,178, filed on May 2, 1997 and entitled "Improved Bolster Land Arrangement for Railcar Truck", discloses that the free travel between the mated bolster and side frame at the side frame columns may be constrained. The clearance or separation gap between the bolster lands and the side frame columns is reduced or eliminated. That patent application does not however, address the need to allow for articulation of the side frame as the track elevations vary.

SUMMARY OF THE INVENTION

The present invention provides a railway truck arrangement that not only reduces truck warping through constraint of the free travel between the mated bolster and side frame at the side frame columns, but also allows for articulation of the side frame as different track elevations are traversed.

BRIEF DESCRIPTION OF THE DRAWINGS

In the figures of the Drawings, like reference numerals identify like components and.

Figure 23:
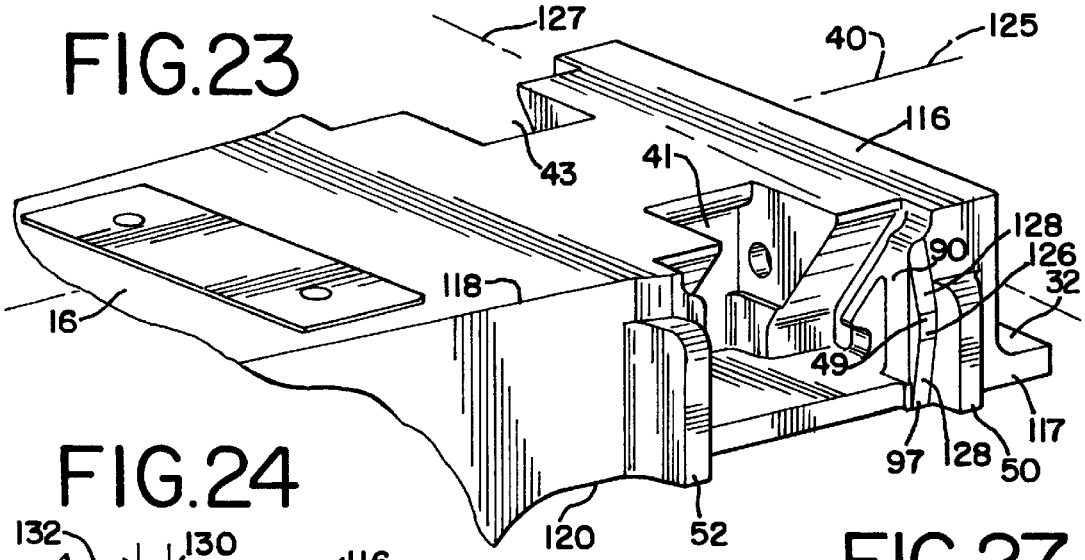
Figure 24:
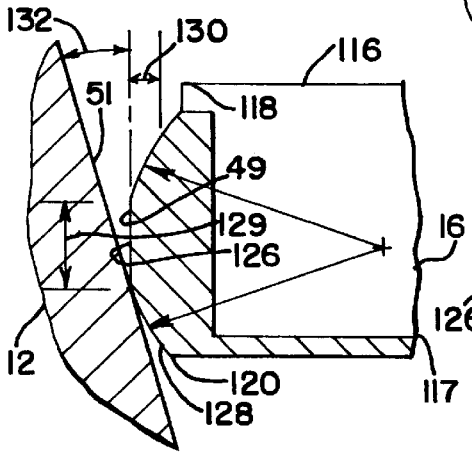
Figure 25:
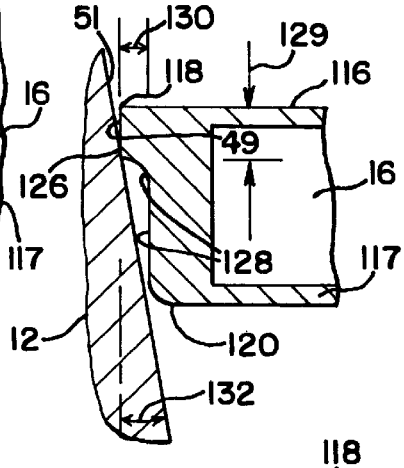
Figure 27:
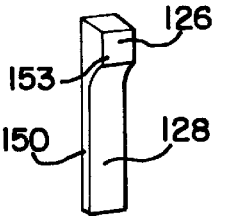
Figure 28:
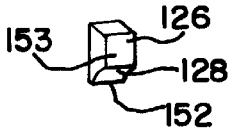
Figure 26:
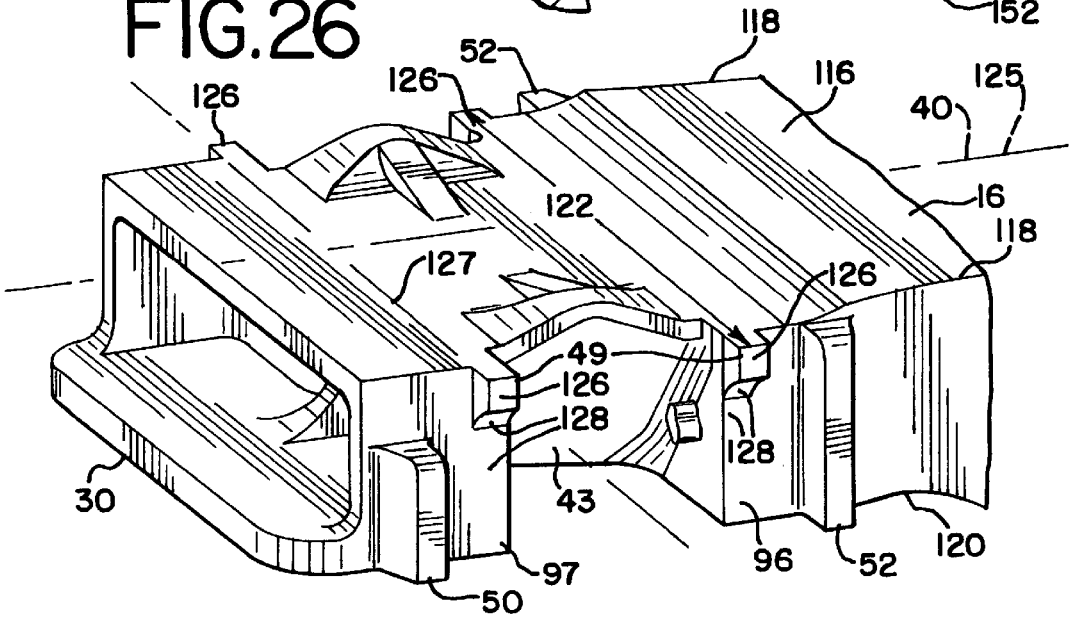
Figure 29:
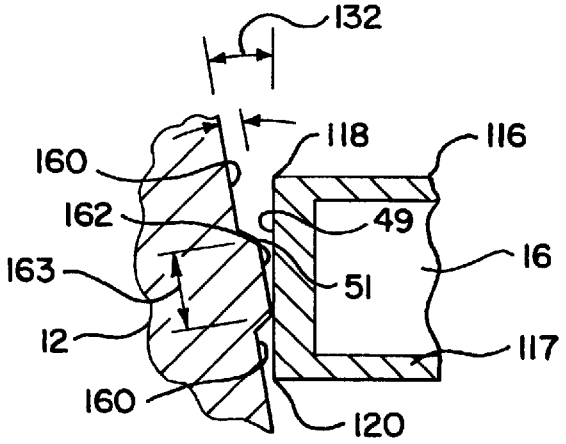
Figure 30:
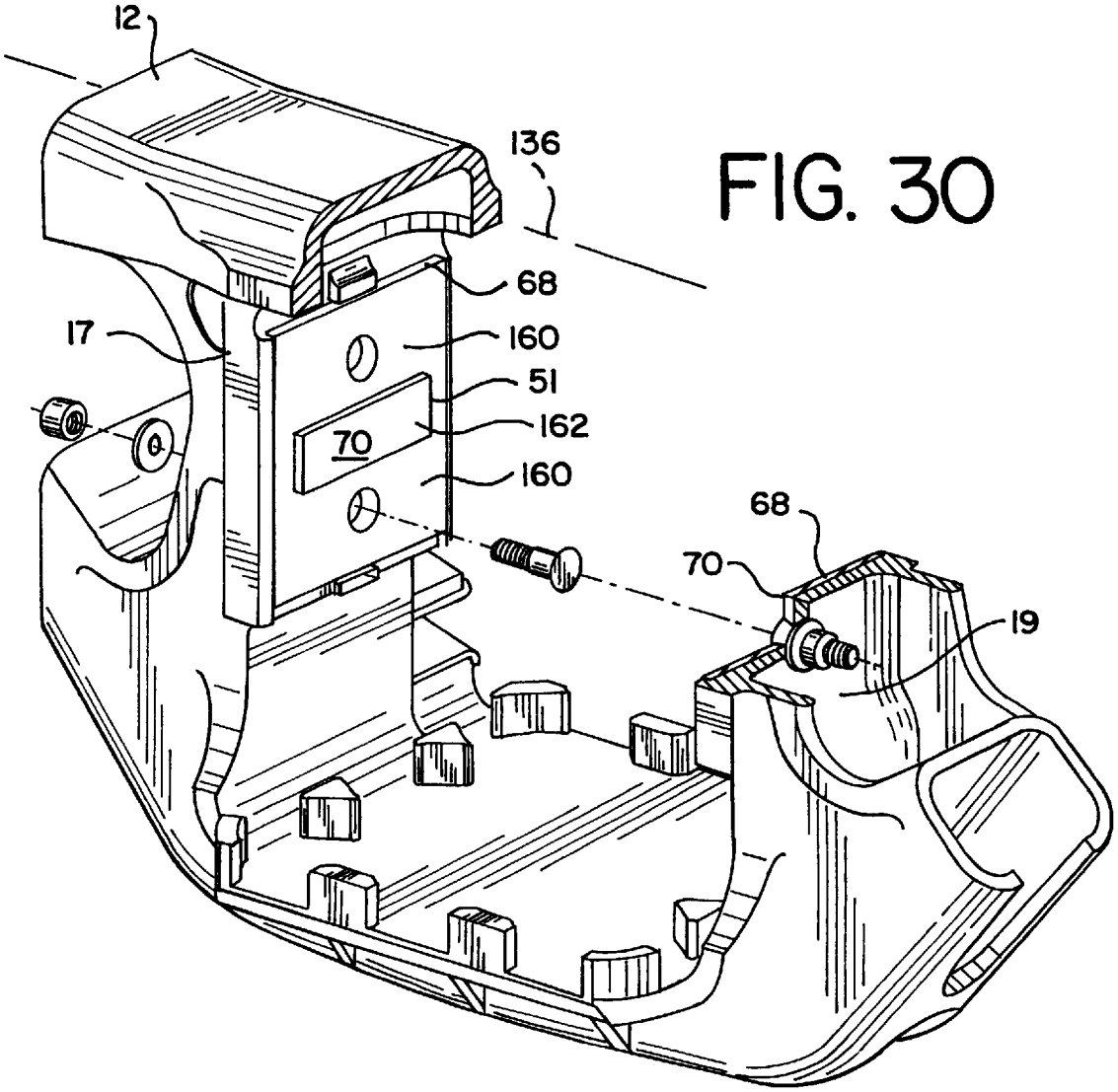

21 embodiment, the bolster being of the type for use with a variable control type of friction shoe;

FIG. 23 is a partial oblique view of a bolster end with lands having another embodiment of warp control and relief portions, the bolster being of the type for use with a constant control type of friction shoe;

FIG. 24 is a partial cross-section of the FIG. 23 embodiment of the side frame and bolster interface, showing angular displacement of the side frame with respect to the bolster at the interface through pitching;

FIG. 25 is a partial cross-section of another embodiment of the side frame and bolster interface, showing angular displacement of the side frame with respect to the bolster at the interface through pitching;

FIG. 26 is a partial oblique view of a bolster end with lands having the warp control and relief portions of the FIG. 25 embodiment, the bolster being of the type for use with a variable control type of friction shoe;

FIG. 27 is an oblique view of a wear member of the present invention;

FIG. 28 is an oblique view of another embodiment of a wear member of the present invention;

FIG. 29 is a partial cross-section of another embodiment of the side frame and bolster interface, showing angular displacement of the side frame with respect to the bolster at the interface through pitching; and FIG. 30 is a partial oblique view of the side frame of the FIG. 29 embodiment.

DETAILED DESCRIPTION

Figure 1:
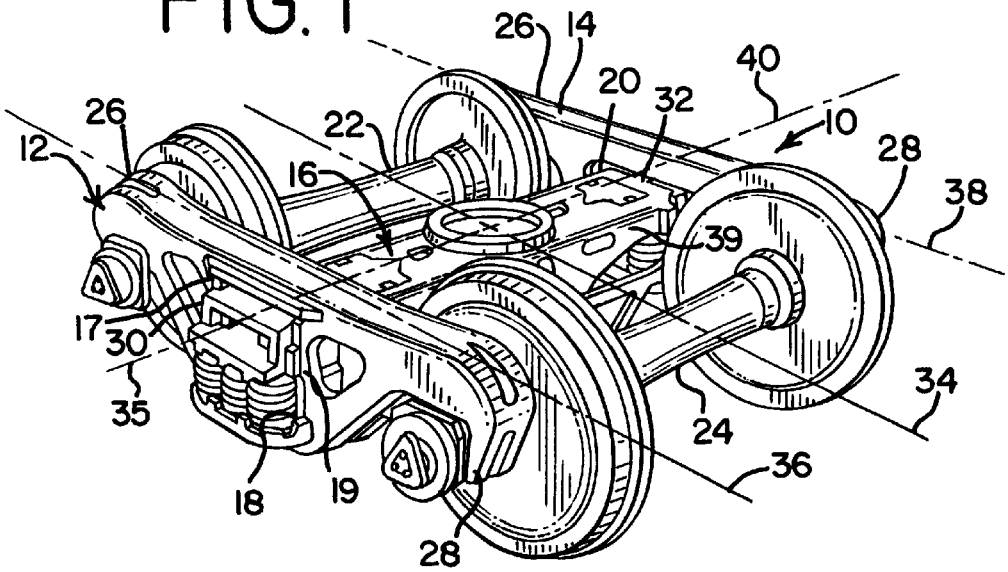
FIG. 1 is an oblique view of a representative three-piece railcar truck assembly.

Railcar truck assembly 10 in FIG. 1 is a representative three-piece truck assembly for a freight railcar (not shown). Assembly 10 has a first side frame 12, second side frame 14 and bolster 16 extending between generally central openings 18, 20, which openings 18, 20 are between forward side frame column 17 and rearward side frame column 19, of the first and second side frames 12, 14, respectively. In FIG. 1, railcar truck assembly longitudinal axis 34 is parallel to both the first and second side frame longitudinal axes 36, 38. Bolster longitudinal axis 40 is generally perpendicular to railcar truck longitudinal axis 34 and to side frame longitudinal axes 36, 38 at the railcar as-assembled reference position shown in FIG. 1. At the as-assembled position, the truck assembly transverse axis 35 corresponds with the bolster longitudinal axis 40. First axles and wheel set 22 and second axle and wheel set 24 extend between side frames 12, 14 at their opposite forward ends 26 and rearward ends 28, respectively. The side frames 12, 14 are generally parallel to each other at the as-assembled condition shown in FIG. 1. First bolster end 30 is nested in first side frame opening 18 and second bolster end 32 is nested in second side frame opening 20.

Figure 2:
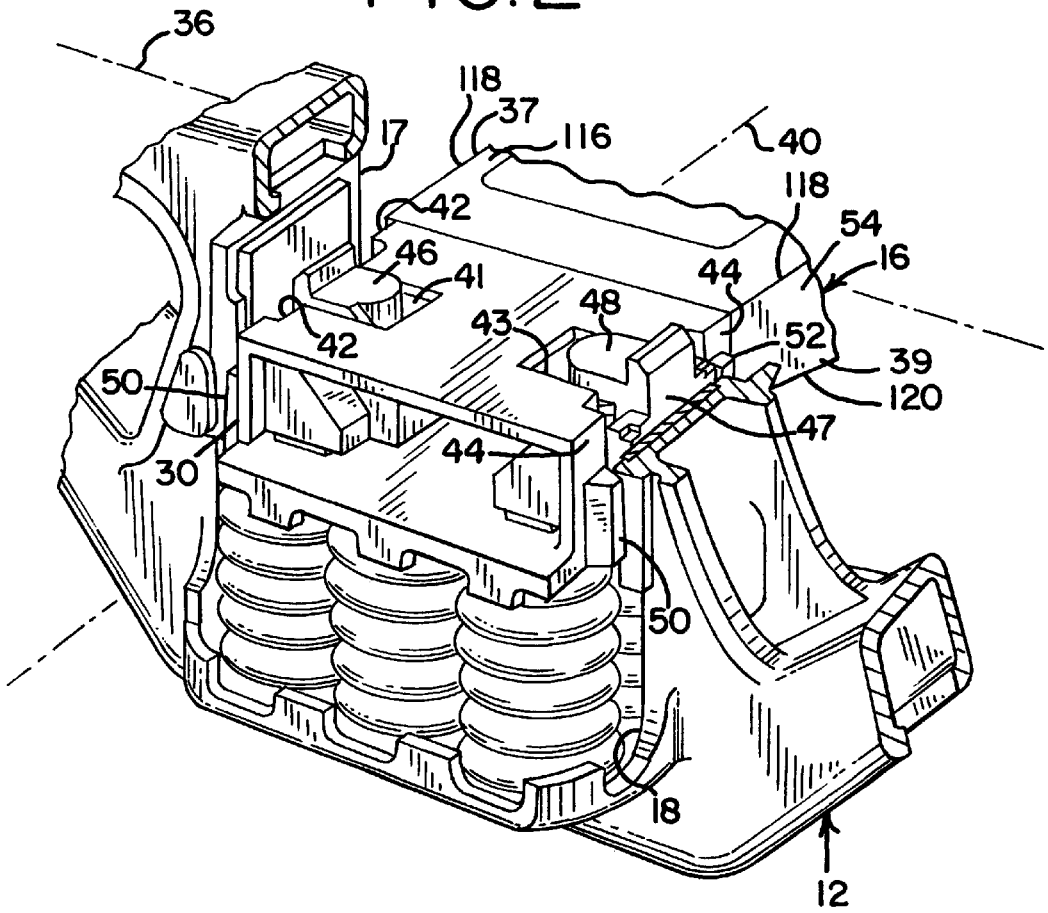
FIG. 2 is an enlarged oblique view in partial section of a portion of one side frame and bolster connection in FIG. 1 at the columns of one side frame.

The connection of bolster 16 in openings 18 and 20 is similarly configured for either side frame 12, 14, and the following description will be provided for the connection of bolster first end 30 at first side frame opening 18, but the description will also be applicable to the connection of bolster second end 32 in second side frame opening 20. The first bolster end 30 has exposed bolster columns 42, 44 between gibs 50 and 52 on both the forward side 37 and rearward side 39 of the bolster. Each bolster column 42, 44 may have friction shoe pockets, shown at 41 and 43 in FIG. 2. There may be friction shoes 46 and 48 in each friction shoe pocket. The bolster may have a constant control type of friction shoe or a variable control type of friction shoe, having a vertical wearing surface 47, or the bolster columns 42, 44 may comprise a continuum between the gibs 50, 52, as disclosed in U.S. patent application Ser. No. 08/850,178 entitled "Improved Bolster Land Arrangement for Railcar Truck", filed on May 2, 1997 by V. Terrey Hawthorne, Charles Moehling, Charles P. Spencer and Terry L. Pitchford, which is incorporated by reference herein in its entirety. At each end of the bolster 16, friction shoe pockets 41, 43 and friction shoes 46, 48 as well as bolster columns 42, 44 are longitudinally arranged on forward side wall 37 and rearward side wall 39 of bolster 16, respectively.

Figure 3:
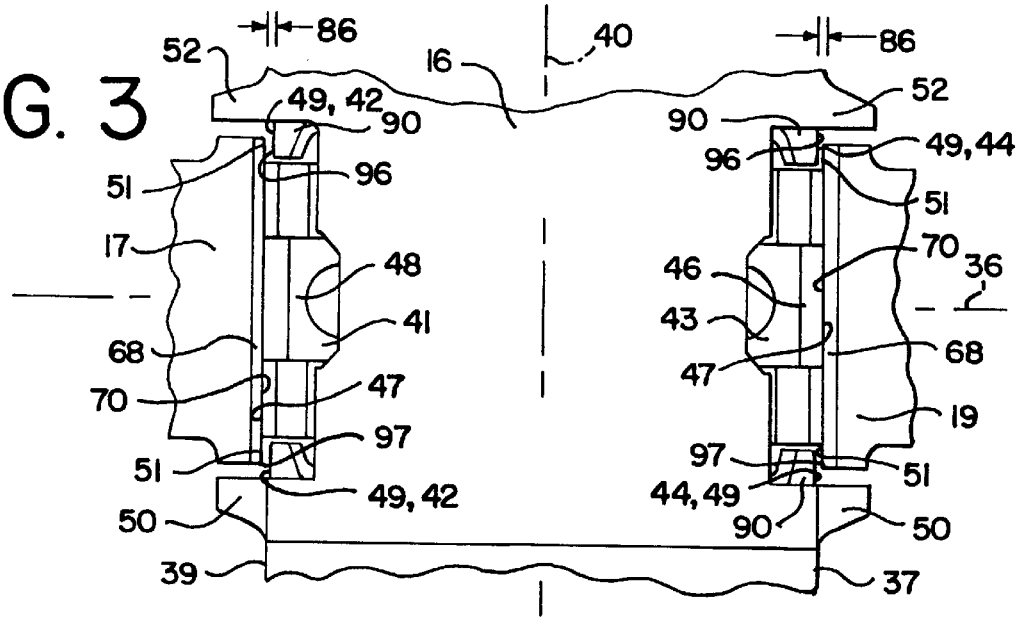
FIG. 3 is a top plan view of a side frame and bolster connection at a reference and normal position.
Figure 5:
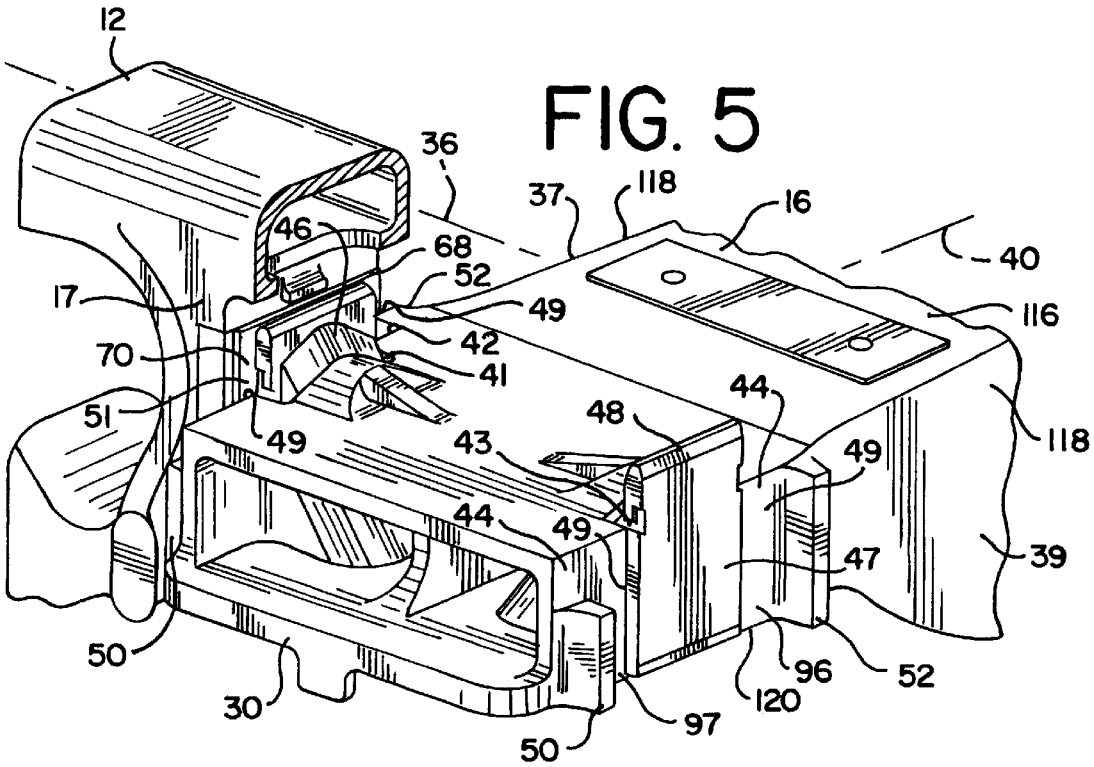
FIG. 5 is an enlarged oblique view in partial section of a portion of a prior art side frame and bolster connection showing the structure of a conventional bolster using a variable control type friction shoe.

The bolster columns 42, 44 and side frame columns 17, 19 provide opposing stop surfaces. As shown in FIG. 3, the bolster stop surfaces 49 are on both the forward side wall 37 and rearward side wall 39 of the bolster. It should be understood that such bolster stop surfaces 49 are at each end of the bolster 30, 32 at the interface with each side frame column 17, 19, and the description of the interfaces at one end of the bolster applies to the other end as well. For bolsters having friction shoe pockets, 41, 43, the bolster stop surfaces 49 may comprise inboard and outboard lands 96, 97 between the gibs 50, 52 and the friction shoe pocket, as shown in FIG. 5. The lands 96, 97 could also be surfaces of projections 90 of the bolster column walls as shown in FIG. 3. If a bolster is provided with a continuous surface between the gibs 50, 52, the stop surfaces 49 may comprise all or parts of the continuous surface. It should be understood that the bolster stop surfaces 49 on each end 30, 32 of the bolster 16 and on both the forward and rearward sides 37, 39 are generally the same, and that the description applies to both ends 30, 32 and both sides of the bolster.

Figure 4:
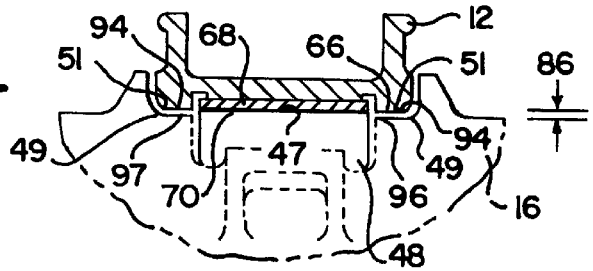
FIG. 4 is a plan view segment in partial section of a side frame and bolster intersection of prior art wide land arrangements and showing a relatively wide separation distance between opposing stop surfaces of the bolster and side frame.

The side frame stop surfaces 51 may comprise the wearing surface 70 of a wear plate 68 attached to the side frame column 17 or 19. The wearing surface 70 may contact the wearing surface 47 of the friction shoe 46, 48. The side frame stop surfaces 51 may also comprise a land 94 on a vertical column wall 66 of the side frame column 17 or 19, as shown in FIG. 4. In both instances, the side frame stop surfaces comprise column stop surfaces.

Figure 8:
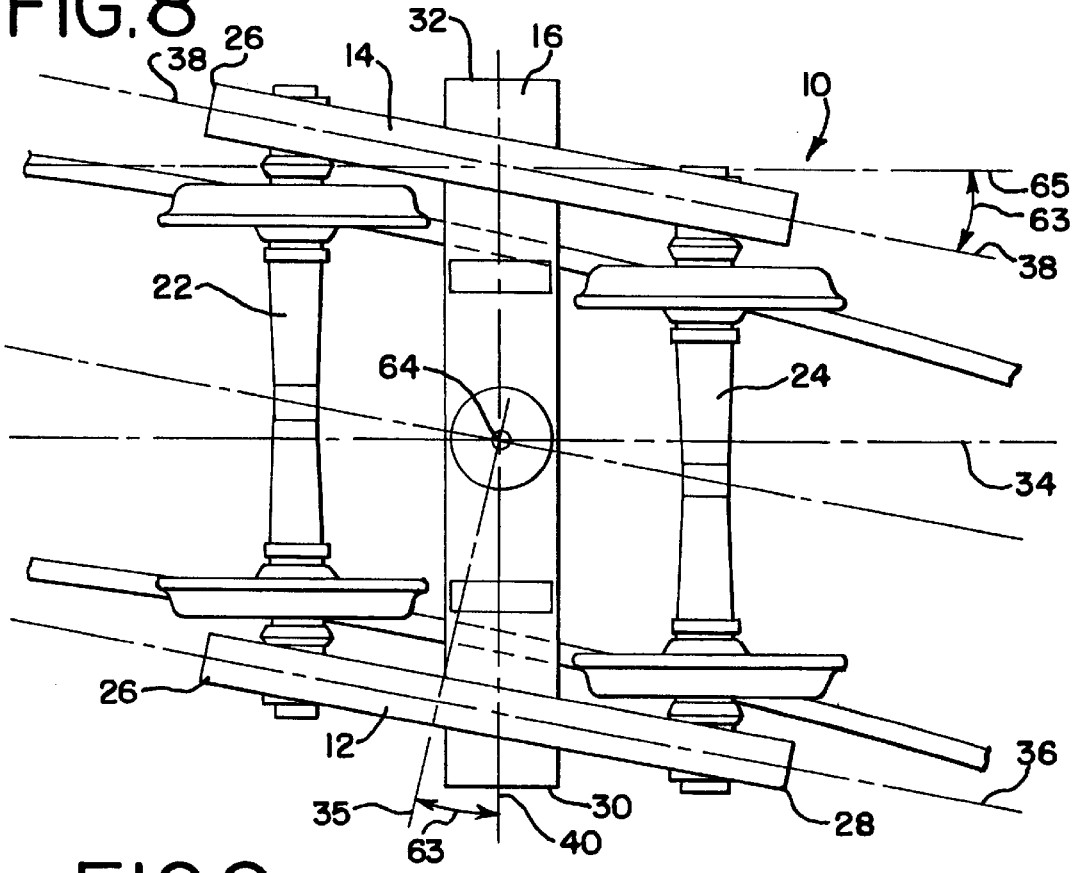
FIG. 8 is a diagrammatic top plan view of a three-piece railcar truck assembly being warped during negotiation of a curve on a railroad track.

In conventional three-piece railcar truck assemblies, warping may occur during operation. An example of warping is shown in FIG. 8, compared to a reference or as-assembled position or condition of the railcar truck assembly 10 shown in FIG. 9. At the warp reference position shown in FIG. 9, the bolster longitudinal axis 40 corresponds with the railcar truck assembly transverse axis 35, and is centered between the forward and rearward columns 17, 19 of both side frames 12, 14. At the warp reference position, the bolster longitudinal axis 40 is generally normal to the railcar truck assembly longitudinal axis 34 and to the longitudinal axes 36, 38 of the side frames 12, 14.

Figure 9:
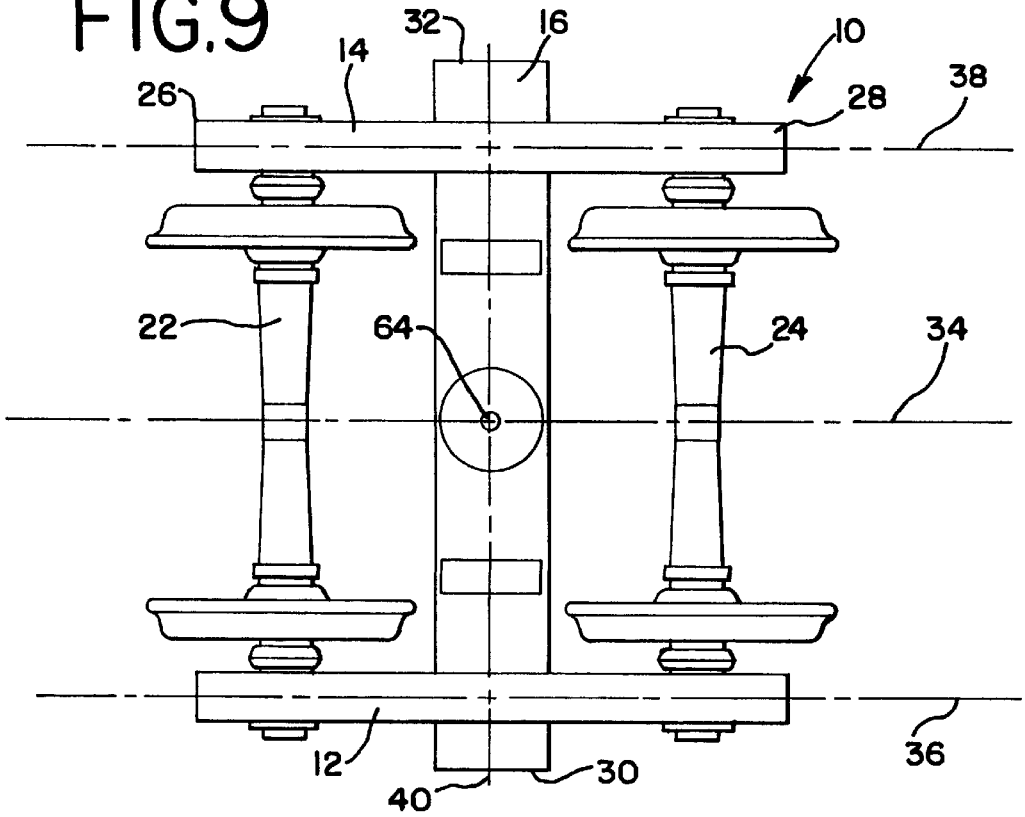
FIG. 9 is a diagrammatic top plan view of a three-piece railcar truck assembly at a warp reference position.

Truck warping involves rotation of the bolster about a vertical axis such as central vertical axis 64 as shown in FIGS. 8 and 9, so that the longitudinal axes 36, 38 of the side frames 12, 14 are no longer perpendicular to the longitudinal axis 40 of the bolster 16. Angular displacement of one or both of the side frame longitudinal axes 36, 38 from the warp reference positions of FIG. 9 define a truck warp angle. As shown in FIG. 8, the truck warp angle 63 is the angle defined by one of the side frame longitudinal axes such as axis 38 with a reference line 65 that is parallel to the truck assembly longitudinal axis 34 in the reference position of FIG. 9, perpendicular to the bolster longitudinal axis 40 and aligned with the reference position of the side frame longitudinal axis as shown in FIG. 9.

In U.S. patent application Ser. No. 08/850,178, entitled "Improved Bolster Land Arrangement for a Railcar Truck", referred to above, the problem of warping between a side frame 12 and bolster 16 is addressed. There, the gap between each pair of opposing bolster and side frame stop surfaces 49, 51 has been narrowed so that the opposing stop surfaces 49, 51 at the interface of the on the sideframe columns 17, 19 and bolster end 30 or 32 are at a negligible separation distance, as compared to a wider gap 86 as shown in FIG. 4.

Substantial advantages may be achieved by limiting each gap distance to a distance less than two-tenths (0.20) inch and preferably less than 3/64 (three sixty-fourths) inch and closer to 1/64 (one sixty-fourth or 0.015) inch. The smaller gap distances are designated 86' throughout this specification and in FIG. 15. With such a small or non-existent gap 86' between each set of opposing side frame and bolster stop surfaces 51, 49, the forward and rearward column or side frame stop surfaces 51 and the bolster stop surfaces 49 are in close enough proximity to maintain control of the warp angle during curving of the railcar and hunting of a railcar truck assembly utilizing these members. The warp stiffness may thus be increased to improve lateral stability and to reduce the lateral curving forces at the wheel to rail interface, thereby improving the hunting and curving performance of the railcar truck assemblies. Limiting the separation distance, that is, the total of the gap distances on both the forward and rearward sides of the bolster, to a distance less than 0.4 (four-tenths) inch and preferably less than 3/32 (three thirty-seconds) inch and closer to 1/32 (one thirty-seconds) inch minimizes or limits the permitted warping angle to an angular displacement between about 0.2° and 2.0°. Thus, the tight land limits yaw, i.e. the tendency to become non-square in a horizontal plane.

Figure 10:
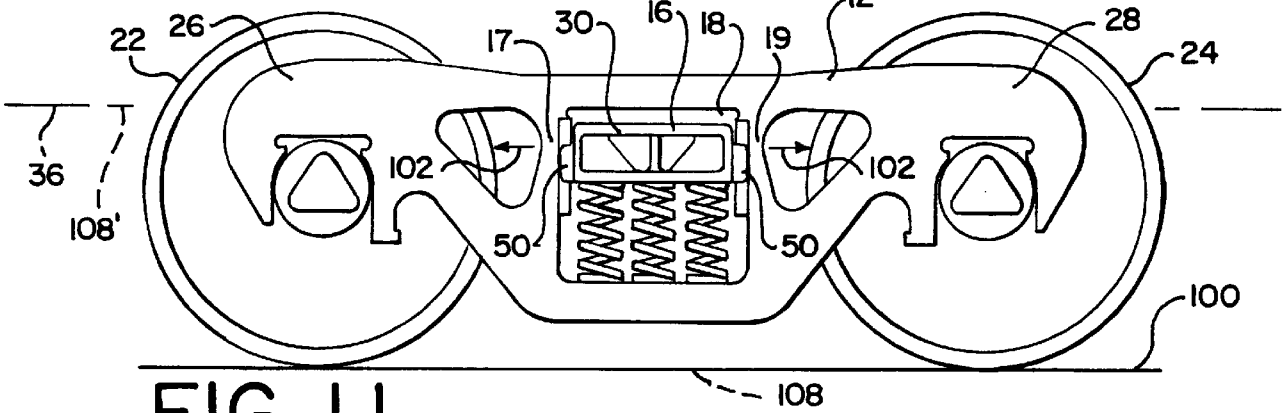
FIG. 10 is an elevation of a representative three-piece railcar truck assembly on a section of horizontal track, with the truck at a pitch reference position.
Figure 11:
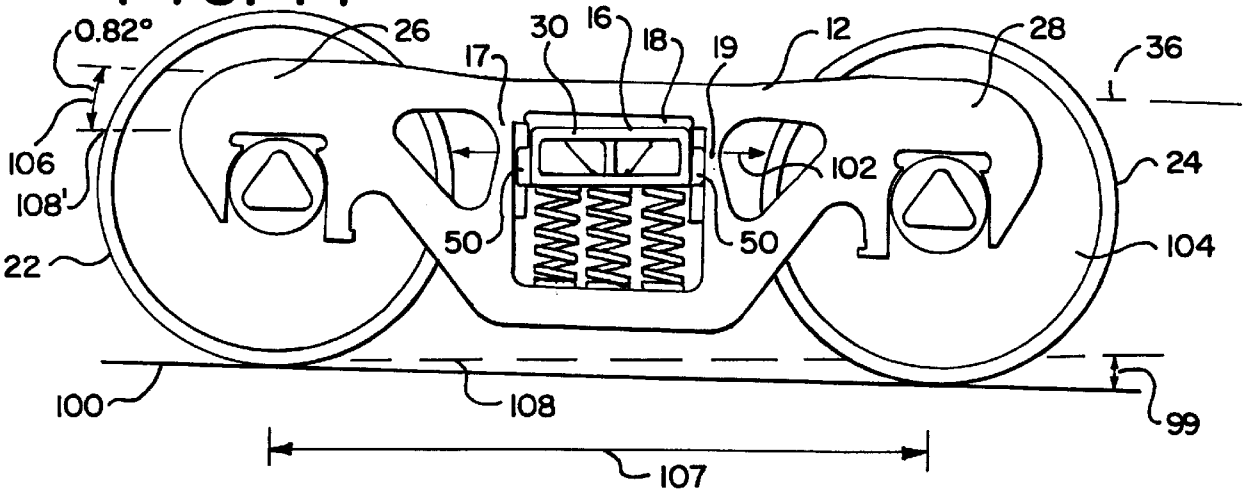
FIG. 11 is an elevation of the truck of FIG. 10 shown traversing a section of track at different elevations.

However, such a limit to the gap 86' distance also limits the relative angular displacement of the side frame and the bolster when track irregularities are encountered, that is, the truck's ability to pitch or articulate when a track depression or elevation in encountered. As shown in FIG. 10, in a pitch reference position, when the railcar truck assembly 10 is on a level track 100, the bolster transverse axis 102 at the bolster end 30 is parallel to the side frame longitudinal axis 36. In the pitch reference position shown in FIG. 10, the top surface of the track 100 coincides with a horizontal reference line 108 and the side frame longitudinal axis 36 coincides with another horizontal reference line 108'. In this pitch reference position, the bolster and side frame contact surfaces 49, 51 may be closely spaced or in contact without binding them and without presenting any undesirable moment at the interface of the bolster and side frame lands. But, as shown in FIG. 11, when a depression or elevation 99 in the track 100 is encountered, at least one wheel 104, and therefore one end 26 or 28 of one or both of the side frames 12, 14, will tend to lower or raise. As an end of the side frame raises, its longitudinal axis 36 or 38 turns about a generally horizontal axis, such as the central longitudinal axis 40 of the bolster. Such an angular displacement of the side frame longitudinal axis 36 or 38 from the pitch reference position parallel to the bolster transverse axis 102 defines a pitch angle, shown at 106 in FIG. 11. If the change in track elevation is large enough, the side frame and bolster stop surfaces 51, 49 may create a moment or undesirable stresses in the side frame and bolster end.

Figure 6:
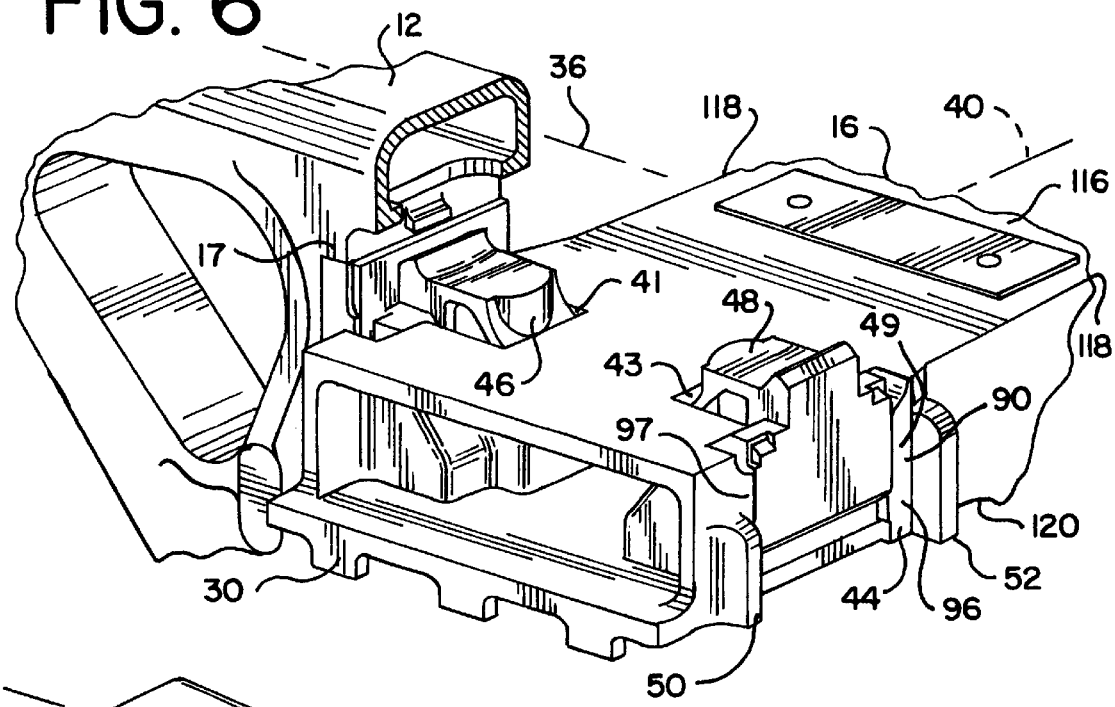
FIG. 6 is an enlarged oblique view in partial section of a portion of a prior art side frame and bolster connection showing the structure of a conventional bolster using a constant control type of friction shoe.
Figure 7:
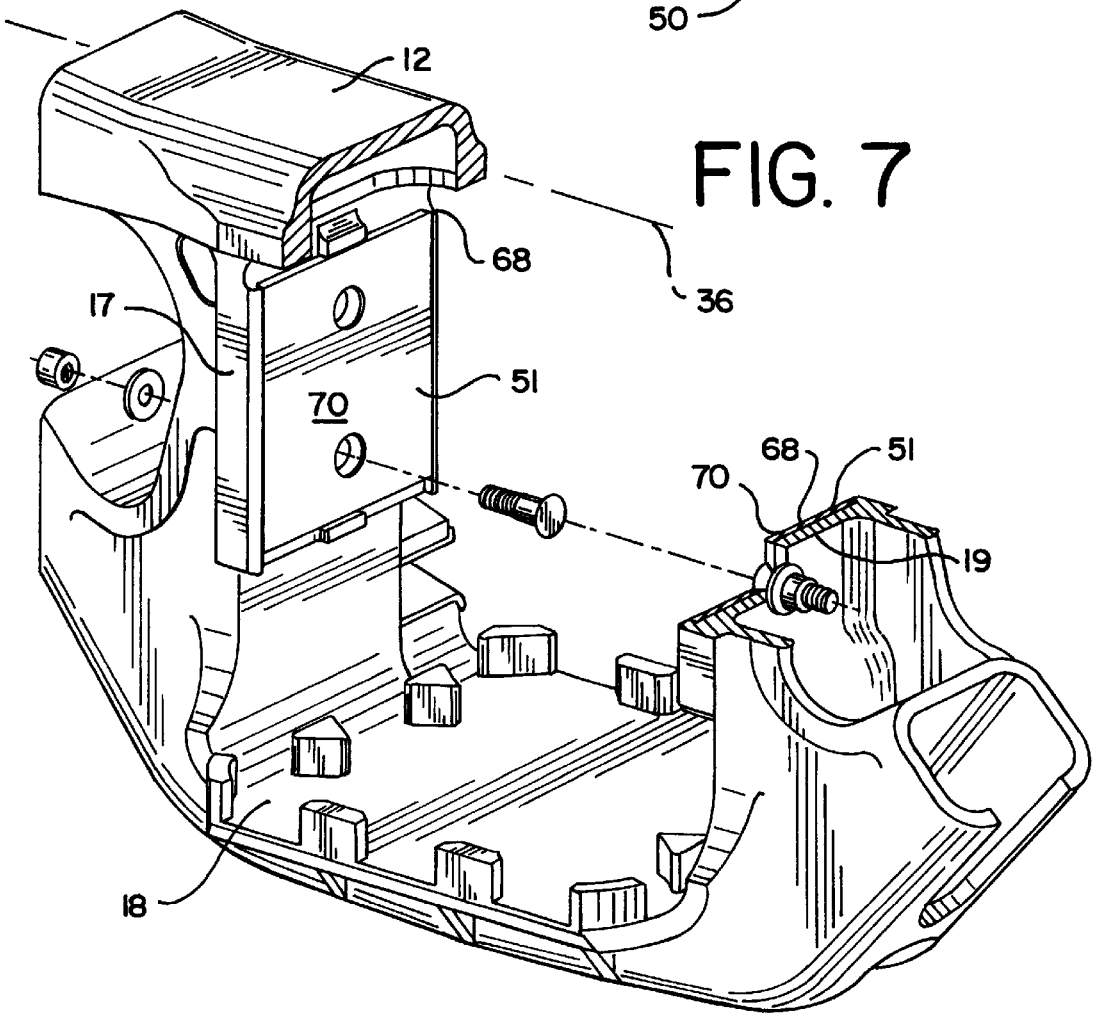
FIG. 7 is an enlarged oblique view in partial section of a portion of a prior art side frame with a wear plate attached.

Bolsters for use in three-piece trucks of the type shown in FIG. 1 have generally been of the types shown in FIGS. 5 and 6. In such bolsters, including those with the improvements of U.S. patent application Ser. No. 08/858,170, the bolster lands 96, 97 have been generally planar surfaces that contact planar surfaces of the side frame. The side frame planar surfaces that comprise the stop surfaces 51 have been planar wear plate surfaces, such as the surface 70 shown in FIG. 7, or planar side frame lands 94, shown in FIG. 4. Depending on the distance between these opposing surfaces 51, 96, 97, these juxtaposed planar surfaces may interfere with each other bind as one wheel is lowered.

The angular effect of lowering one wheel one (1) inch for a railcar truck with such juxtaposed planar surfaces is illustrated in FIG. 11. As there shown, a conventional 100 ton side frame 12 has a 5'10" (70") wheel base shown at 107 in FIG. 11. For one end 28 of a 70 inch wheel base truck to be one inch lower than the opposite end 26, the pitch angle 106 of the side frame would be about 0.82° from the horizontal references shown at 108 and 108' in FIG. 11. This 0.82° angle is the arctan of 1.0/70.0. But if there is a clearance of 1/32" or 0.03 inch between the juxtaposed planar bolster and side frame stop surfaces, with a typical bolster stop surface 49 comprising a land 96 or 97 having a height of 5¾", the maximum angle that can be accommodated before the opposing stop surfaces 49, 51 prevent articulation between the bolster and sideframe is 0.32°, shown at 109 in FIG. 12, the arctan of 0.03 inch. Thus, the tight side frame-bolster interface would not allow the articulation necessary to traverse a track having a one inch variation in height over the length of the wheel base; if one side frame tips out of horizontal while the other is horizontal, a one inch drop at one wheel will result in binding at a clearance of 1/32" between the side frame land 94 or wear plate 58 and bolster land 96, 97.

The present invention provides an interface between the side frame and the bolster stop surfaces 51, 49 that not only advantageously limits warping or yaw movement through a tight clearance at each side frame-bolster interface, but also allows freedom for pitch movement of the sideframe. That is, the present invention allows the side frame 12, 14 to turn about a horizontal transverse axis, such as the bolster longitudinal axis 40, and thus allows for predetermined changes in the pitch angle of the side frame as the railcar truck assembly traverses track with variations in elevation. It should be understood that although like numbers have been used for the stop surfaces 49, 51, including lands 94, 96, 97 and wear plates 68 in the various embodiments of the present invention and the prior art, the structures of these parts are not the same as the prior art unless otherwise indicated.

Figure 14:
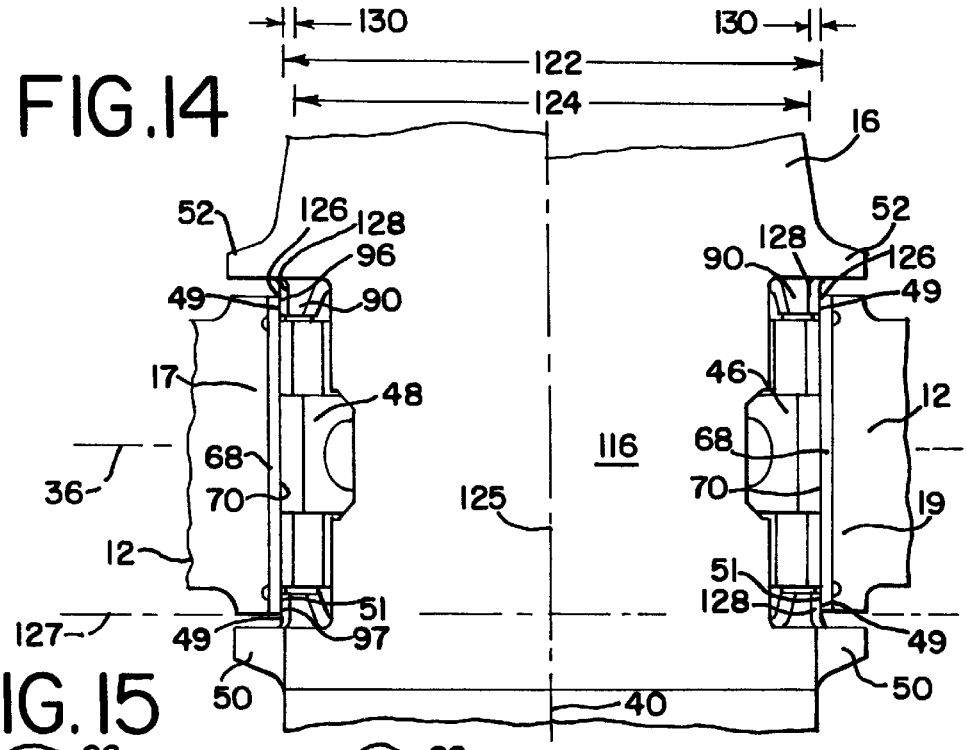
FIG. 14 is a top plan view of a side frame and bolster connection showing the embodiment of FIG. 13 at a reference and normal position.
Figure 15:
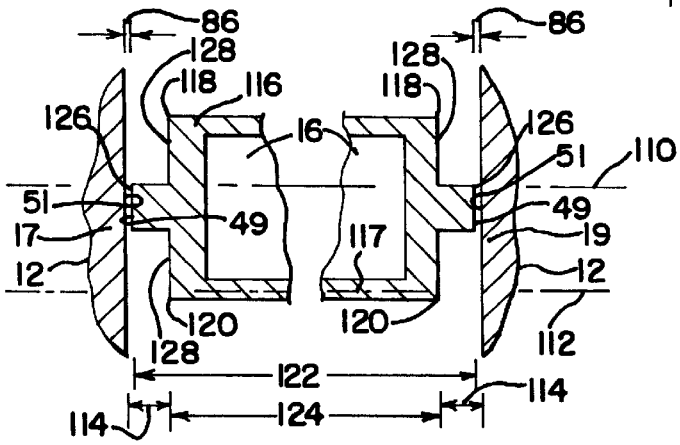
FIG. 15 is a partial cross-section of the embodiment of FIG. 13 at a reference and normal position and showing a small gap between the stop surfaces of the bolster and side frame.

As shown in FIGS. 14–15, in the present invention, each forward and rearward stop surface 49 of the bolster 16 is aligned in a facing relationship with the opposing side frame stop surfaces 51. Generally, the same facing relationship is present at the interface of the other end of the bolster and other side frame. The forward and rearward side frame stop surfaces 51, on both the inboard and outboard sides of each side frame, are in proximity with the forward and rearward bolster stop surfaces 49, on both the inboard and outboard sides of the friction shoes at each end of the bolster, although should be understood that the bolster may be of the type that has a continuous surface. At a first level 110, the opposing stop surfaces 49, 51 are in proximity at a first gap or reference spacing 86' to control the warp angle. At a second level 112, the opposing stop surfaces 49, 51 are in proximity at a second gap or reference spacing 114 to allow for predetermined changes in the pitch angle of the side frame. As shown in FIG. 15, the first and second levels 110, 112 are in separate horizontal planes and the second level 112 is vertically displaced from the first level. The second reference spacing 114 is greater than the first reference spacing 86', preferably by about ⅜ (three-eighths) inch, or by a smaller or larger amount depending on the geometry of the pieces and the desired allowable range of pitch angles. The first spacing or gap 86' at the first level 110 is preferably a tight spacing to provide a gap such as about 1/64 inch, for example, and the second spacing or gap 114 is larger, such as a gap of 4/10 inch, for example, for control of pitch angle. It should be understood that these and other dimensions in this description are given by way of example only. The invention is not limited to any particular dimension, distance or angle unless the claim expressly sets forth a distance, dimension or angle. It should also be understood that the dimensions, distances and angles may be determined for each particular application. For example, knowing the desired warp and pitch angles, one can calculate the gap distances from the geometry of the particular railcar truck assembly side frames and bolster.

In several of the embodiments of the present invention, these different spacings at these levels are achieved by shaping the bolster stop surfaces 49. As shown in FIG. 15, each bolster stop surface 49 includes a warp control portion 126 and at least one relief portion 128. The warp control portion 126 and relief portion 128 are vertically aligned; that is, the two portions 126, 128 are aligned along a transverse plane 127 of the bolster. As shown in FIG. 14, the distance between a central longitudinal plane 125 through the bolster axis 40 and each warp control portion 126 is greater than the distance between this plane 125 and the relief portions 128. The distance between a plane through the contact surface 126 and a parallel plane through the relief portion or surface 128 at the juncture with the bottom edge 120 may be about 3/8 inch, for example.

In the embodiments illustrated in FIGS. 13, 15–20 and 23–26, each bolster warp control portion or surface 126 has a height less than the distance between the top and bottom edges 118, 120 of the bolster 16. This height may be about 1¾ (one and three-quarter) inches, for example. This height of the warp control portion 126 is shown at 129 in FIGS. 17, 20, 24 and 25. The warp control portion 126 may be centered on the horizontal centerline of the bolster land 96, 97, as shown in FIG. 15, or may be placed off-center toward the top edge 118 of the bolster, as shown in the embodiment of FIGS. 25–26. In the embodiments of FIGS. 13–24, there are both upper and lower relief portions 128 that are spaced away from the plane of the warp control portion 126, closer to the bolster longitudinal central plane 125 along axis 40. There may also be a single relief portion or surface 128 as in the embodiment of FIGS. 25–26. The relief portions 128 may be shaped so that at the bottom edge 120 of the bolster, the relief portions 128 are about 3/8 inch closer to the central plane 125 through the longitudinal axis 40, shown in FIG. 14, than are the warp control portions 126, although it should be understood that this distance is given for illustrative purposes; the claims are not limited to any particular distance unless expressly set forth in the claim. This difference in distances is shown at 130 in FIGS. 13, 14, 17, 21, 24 and 25. Thus, at a 1/32 inch spacing between the warp control portions or surfaces 126 of the bolster and the stop surfaces 51 of the sideframes 12, 14, the side frame stop surface 51 may reach an angle of 1.05° before the side frame stop surface contacts the bolster relief surface, since there is a spacing of more than 0.4 inch between the side frame stop surface and at least parts of the relief portions of the bolster stop surfaces. Examples of the side frame pitch angles that may be allowed by the present invention are shown at 132 in FIGS. 13, 17, 20, 21, 24, 25 and 29. As can be seen from a comparison of FIGS. 12 and 13, the present invention allows for the warp control benefit of a small gap between the stop surfaces 49, 51 while allowing for the side frame to pitch a predetermined amount in response to differences in track elevation. Since 1.05° exceeds the angle for a one-inch variation in track level, a truck utilizing the present invention can articulate over a one-inch variation in track height without binding while it can also maintain the desirable squaring of the side frames and bolster. Other ranges of allowable pitch angles may be selected, and the dimensions and distances selected to allow the necessary articulation between the side frames and the bolster.

Figure 12:
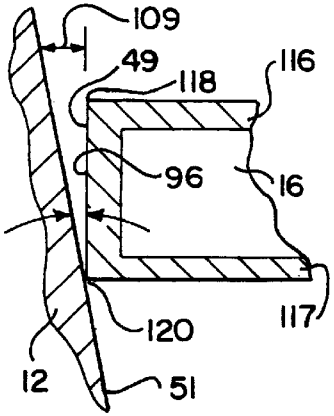
FIG. 12 is a partial cross-section of a side frame and bolster showing angular displacement of the side frame with respect to the bolster through pitching.
Figure 13:
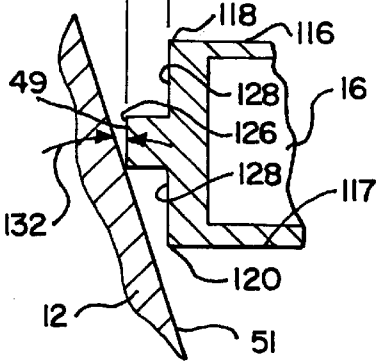
FIG. 13 is a partial cross-section of an embodiment of the side frame and bolster interface of the present invention, showing angular displacement of the side frame with respect to the bolster the interface.
Figure 16:
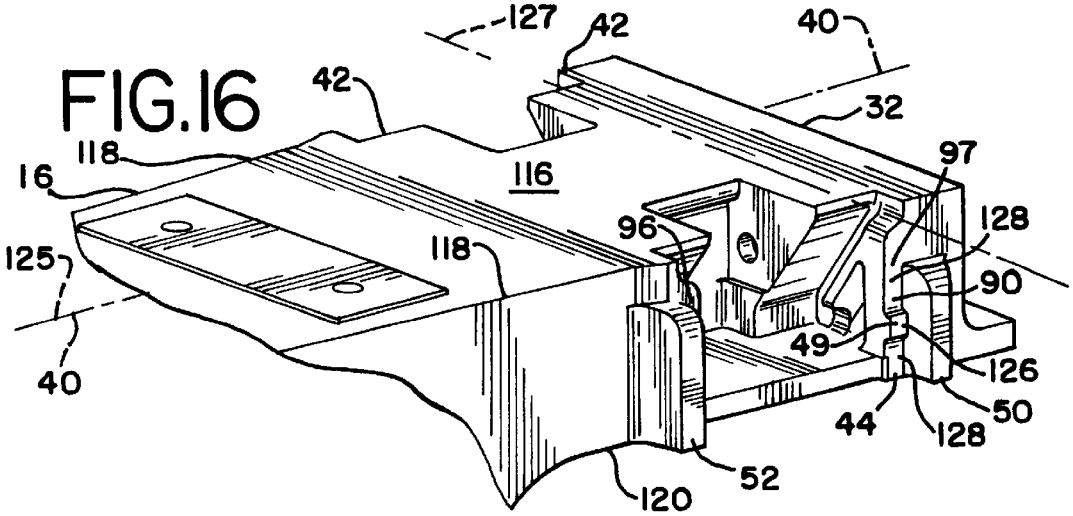
FIG. 16 is a partial oblique view of a bolster end with stop surfaces having warp control portions and relief portions of the types shown in FIGS. 13–15.
Figure 17:
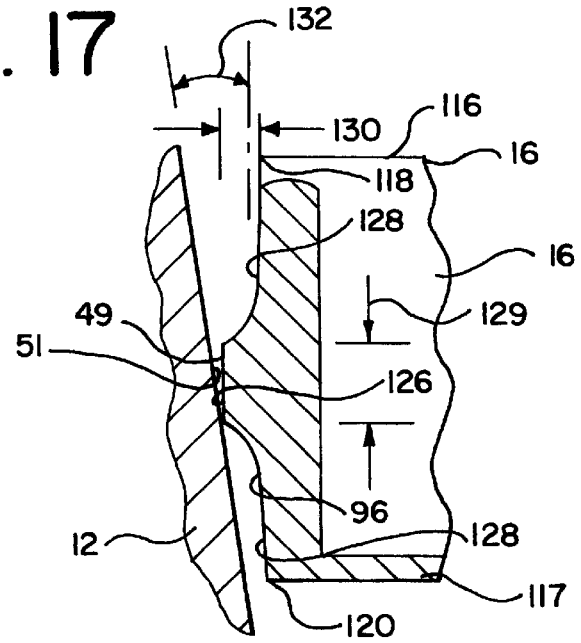
FIG. 17 is a partial cross-section of another embodiment of the side frame and bolster interface of the present invention, showing angular displacement of the side frame with respect to the bolster at the interface through pitching.
Figure 18:
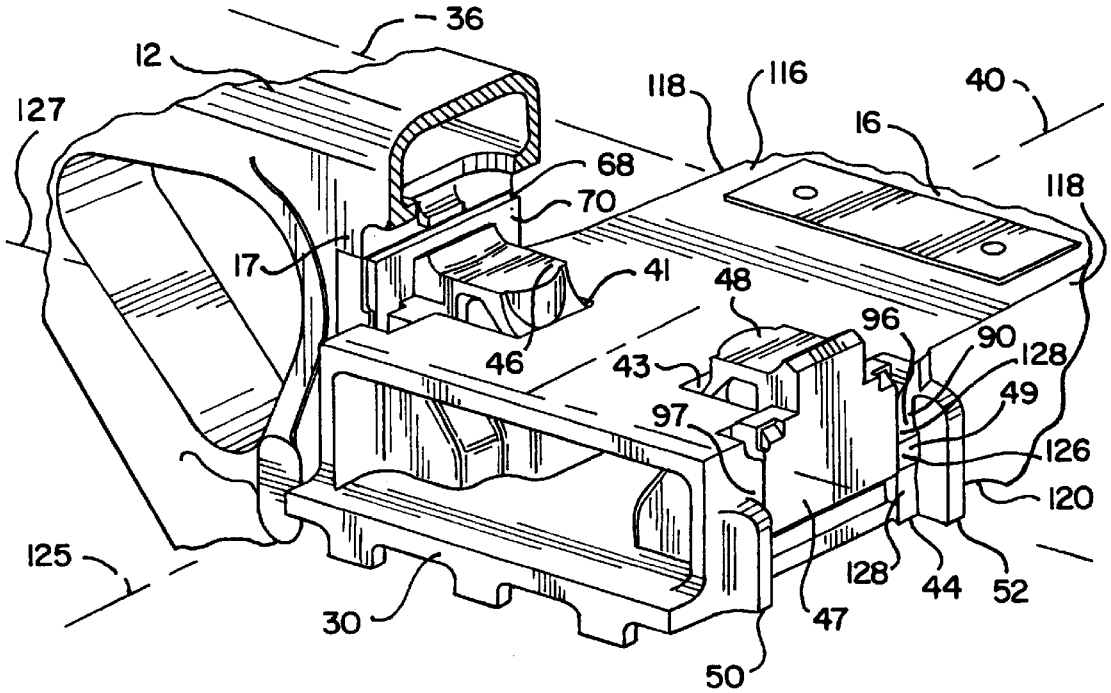
FIG. 18 is an enlarged oblique view in partial section of a portion of one side frame and bolster interface showing the structure of a bolster using a constant control type of friction shoe and a bolster stop surface having warp control and relief portions shaped as in the FIG. 17 embodiment.
Figure 19:
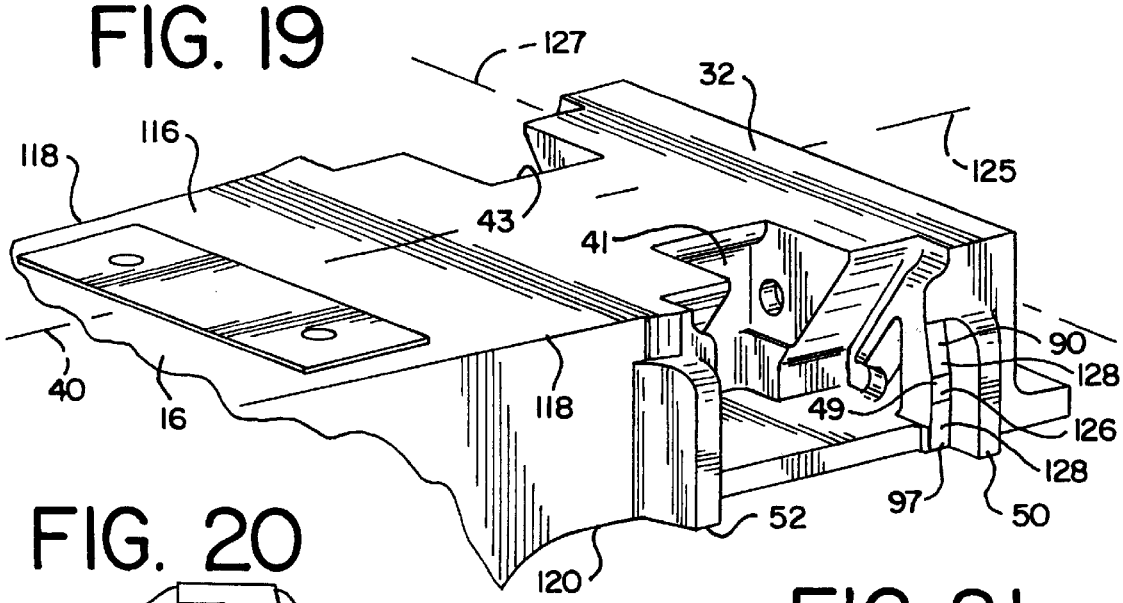
FIG. 19 is a partial oblique view of another embodiment of a bolster end with stop surfaces having warp control and relief portions.
Figure 20:
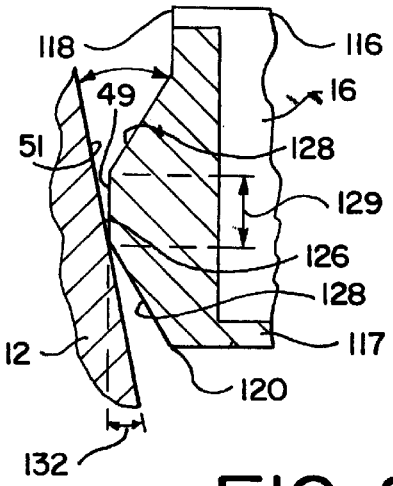
FIG. 20 is a partial cross-section of the FIG. 19 embodiment of the side frame and bolster interface, showing angular displacement of the side frame with respect to the bolster at the interface through pitching.
Figure 21:
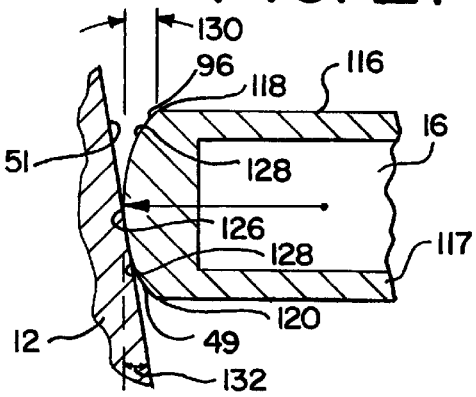
FIG. 21 is a partial cross-section of another embodiment of the side frame and bolster interface, showing angular displacement of the side frame with respect to the bolster at the interface through pitching.
Figure 22:
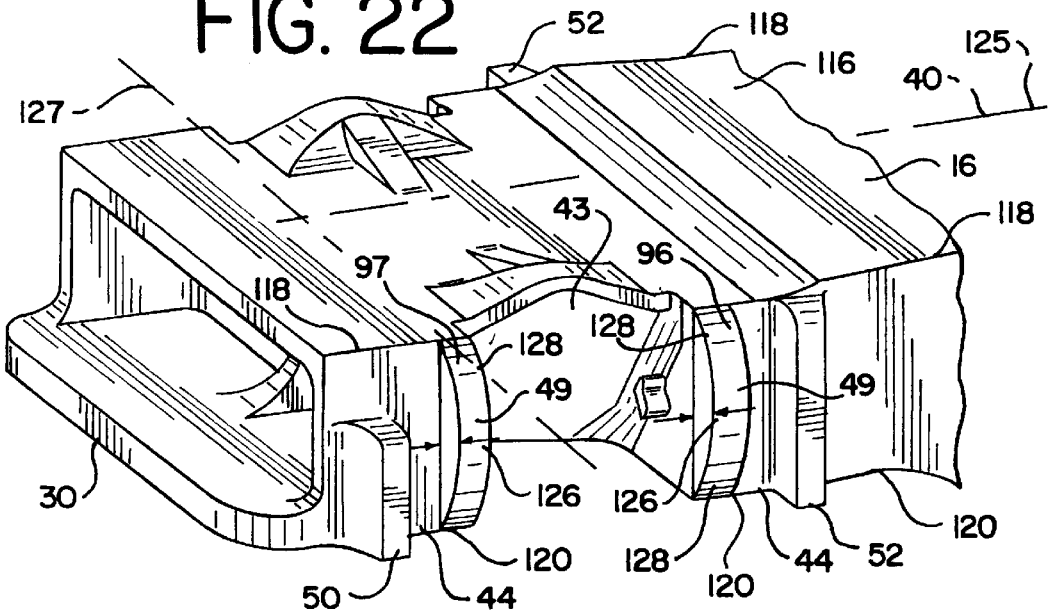
FIG. 22 is a partial oblique view of a bolster end with lands having the warp control and relief portions of the FIG.

As shown in the embodiment of FIGS. 13 and 15–16, the bolster stop surface 49 could have a warp control portion 126 with straight undercuts to form the relief portions 128, with the relief portions in planes parallel to the plane of the warp control portion 126 but spaced from the warp control portion by about 3/8 inch. As shown in the embodiment of FIGS. 17–12 18, the warp control portion 126 of the bolster stop surface 49 may be planar, with the relief portions 128 of the bolster stop surface above and below the planar warp control portion 126 and including a pair of smooth concave curved surfaces in cross-section, the concave curved surfaces joining the warp control portion 126 to planar relief surfaces at the top and bottom edges 118, 120 of the land 96, 97. As shown in the embodiment of FIGS. 19–20, the bolster stop surface's warp control portion 126 may comprise a planar surface, and the bolster stop surface's relief surfaces 128 may be angled to lie in planes intersecting the warp control portion 126 and extending to a maximum relief at a plane through the top and bottom edges 118, 120, or to the top and bottom edges 118, 120 themselves. As shown in FIGS. 21–22, the entire land surface 96, 97 could comprise a convex curve or radius in cross-section, with the warp control portion 126 centered between the top and bottom edges 118, 120 and maximum reliefs at the top and bottom edges 118, 120 of the land. In the embodiment of FIGS. 21, 22, the warp control portion 126 of the bolster stop surface 49 may comprise a line or area on the convex curved surface, and the curved surface may extend to a maximum of 3/8 inch, for example, from the plane through the top and bottom edges 118, 120 of the bolster end. As shown in the embodiment of FIGS. 23–24, the warp control portion 126 may comprise a planar surface lying in a plane parallel to the plane through the top and bottom edges 118, 120 of the bolster and the space between these planes may be about 3/8 inch, for example. In the embodiment of FIGS. 23–24, the relief surfaces 128 comprise convex curves in cross-section, curving from the flat warp control portion 126 to the maximum reliefs at the plane through the edges 118, 120 of the bolster lands. As shown in the embodiment of FIGS. 25–26, the warp control portion 126 of the bolster stop surface 49 need not be centered on the land 96, 97; the warp control portion 126 may be at the top edge 118 of the land 96, 97, for example, and a single relief 128 may extend from the warp control portion 126 to the bottom edge 120 of the land 96, 97, with the bottom edge 120 of the land comprising the maximum relief. Whether the relief comprises a curved or planar surface, or some combination of curved and planar surfaces, the distance between the warp control portions or surfaces 126 on the aligned forward and rearward stop surfaces is generally the maximum width of the bolster at the lands 96, 97; this distance or maximum width is shown at 122 in FIGS. 14–15. As also seen in FIGS. 14–15, for example, the relief surfaces 128 generally converge from this maximum width toward the bolster bottom 117, the bolster top 116, or both the bolster bottom and top to a minimum width of the bolster at the lands 96, 97 that is about ¾ inch less than the maximum width; the minimum width is shown in FIGS. 14–15 at 124. In each embodiment, the maximum reliefs 128 are spaced a sufficient distance from the side frame wear plate wearing surface 70 or column land surface 94 to clear the wear plate or land surface and to allow articulation of the side frames, and the distance between the bolster warp control portion or surface 126 and the side frame wear plate wearing surface 70 or side frame land 94 is small enough to maintain control of the warp angle between the end of the bolster and the side frame during curving and hunting of the railcar truck assembly. In the illustrated embodiments, the gap 86' between the bolster warp control portions or surfaces 126 and the side frame wear plate wearing surfaces 70 or side frame land 94 is preferably as disclosed in U.S. patent application Ser. No. 08/850,178, and is preferably between 1/64 and 3/64 inches, although in some instances the gap may be up to 0.2 inch, for example, while the gap distance 114 between each pair of opposing maximum relief surfaces 128 of the bolster lands 96, 97 and the side frame wear plate wearing surfaces 70 or side frame lands 94 may be about 3/8 inch greater than the warp control gap 86', or around 0.4 inch, and preferably each pitch control gap 114 is between 0.390 and 0.422 inch, although smaller pitch control gaps 114 may be desired if it is desired to further limit the maximum pitch angle, and larger pitch control gaps 114 up to about 0.575 inch or greater may be used. It should be understood that these distances are given for purposes of illustration only. Moreover, in all of these embodiments utilizing friction shoes 46, 48, the bolster warp control portions or surfaces 126 are on both sides of the friction shoe 46, 48, and do not extend any closer to the side frame wear plate wearing surface 70 than the vertical surface 47 of the friction shoe, and the friction shoe vertical surface 47 is planar, with no relief surfaces.

It should be understood that any of the illustrated embodiments may be used with either the type of bolster used with constant control friction shoes or with the type of bolster used with variable control types of friction shoes, or with bolsters having a continuum between the gibs 50, 52. It should also be understood that any of the illustrated embodiments may be used at one or more or the bolster stop surfaces 49 or lands 96, 97, at both ends 30, 32 of the bolster, on both the forward side wall 37 and rearward side wall 39 of the bolster, and for one or both of the inboard and outboard lands 96, 97. Moreover, any of the illustrated embodiments may be used with standard side frames, such as the types of side frames shown in FIGS. 4 and 7 and standard wear plates 68.

Any of the illustrated warp control and relief portions or surfaces of the bolster stop surfaces may be cast as part of the bolster. Alternatively, a separate extension member having any of the illustrated shapes could be made and attached to a conventional bolster. Examples of such extension members are illustrated in FIGS. 27–28, and are designated 150, 152 in these Figures. The extension member 150 may have a surface 153 that comprises the warp control portion or surface 126, along with one or more relief portions or surfaces 128 of the any of the types illustrated, as shown in FIG. 27. Alternatively, the extension member 152 as shown in FIG. 28 may include a surface 153 that defines the warp control portion 126, with an undercut or other surface to join the bolster land surface, in which case the bolster land surface could also comprise part of the relief portion of the bolster stop surface. The extension member 150, 152 may be attached to a bolster of the type shown in FIGS. 5–6 by welding or the like and then be removed and replaced as necessary. The extension member 150, 152 may be a wear plate.

As shown in FIGS. 29–30, a relief surface 160 may alternatively be formed in the side frame friction or wear plate wearing surface 70 mounted to the side frame column. As there shown, the wear plate or column wall may have a planar warp control portion or surface 162 for contacting the vertical surface 47 of the friction shoe 46, 48 and the bolster land 96, 97, with the side frame or wear plate reliefs 160 formed above and below the side frame warp control portions 162, with maximum reliefs spaced about 3/8 inch or more back from the planar warp control surface 162. The warp control portion 162 may have a height, shown at 163 in FIG. 29, of about 1¾ inches, for example. Such a structure should allow side frame articulation as shown in FIG. 29 while retaining the benefits of a tight land clearance. For a side frame of the type shown in FIG. 4, there could be reliefs and warp control portions or surfaces formed on the side frame lands 94. Although not illustrated in the drawings, it should be understood that the structures of the alternative embodiments shown in FIGS. 13–28 for the bolster lands could also be applied to the side frame columns or wear plates. The bolster used with either such side frame could be a conventional one such as those illustrated in FIGS. 5–6. There could also be relief portions or surfaces 128, 160 in both the bolster lands 96, 97 and the side frame land 94 or friction plate 68, so that the side frame of FIG. 30 may be used in combination with the bolsters of FIGS. 13–26.

The bolster stop surfaces could also comprise surfaces on the bolster gibs, and the side frame stop surfaces could comprise facing surfaces on the side frame lugs, as disclosed in the application for United States Patent entitled "Side Frame-Bolster Interface for Railcar Truck Assembly" and filed concurrently herewith by Charles P. Spencer. That patent application is incorporated by reference herein in its entirety. As there disclosed, additional outboard lugs may be formed on the side frames. The opposing surfaces of the bolster gibs and side frame lugs may each have warp control portions and relief portions thereon of any of the types illustrated in FIGS. 13–28. The gap distances at the gibs and lugs may be set at the abovedescribed distances, or the preferred gap distances may vary and may be determined from the geometry and dimensions of the side frames and bolster and the desired ranges of pitch and warp angles.

In any of the above embodiments, a plurality of the stop surfaces 49, 51 include warp control portions 126 to allow for predetermined changes in the warp angle, and a plurality of the stop surfaces 49, 51 include relief portions 128 that comprise pitch control portions to allow for predetermined changes in the pitch angle of the side frame as the railcar truck assembly traverses track with variations in elevation. In these embodiments, the gaps 86', 114 between opposing warp control portions 126 and pitch control portions 128 may be selected so that the maximum pitch angle allowed by said pitch control portions is different from the maximum warp angle allowed by said warp control portions. For example, as discussed above, with a gap 86' of fifteen thousandths (0.015) inch, that is, 1/64 inch, between the warp control portions 126, the warp angle is limited to 0.22°, that is, about 0.2°. With a gap 114 of more than 0.4 inch between the pitch control portions 128, the maximum allowable pitch angle should exceed 1°.

While only specific embodiments of the invention have been described and shown, it is apparent that various alterations and modifications can be made therein. It is, therefore, the intention in the appended claims to cover all such modifications and alterations as may fall within the scope and spirit of the invention. Moreover, the invention is intended to include equivalent structures and structural equivalents to those described herein.

I claim:

1. A railcar truck assembly comprising a bolster and two side frames, said railcar truck assembly having a longitudinal axis and a perpendicular transverse axis, the transverse axis extending the length of the truck bolster;

each side frame having a longitudinal axis, a forward column and a rearward column;

each side frame forward column and rearward column cooperating to define an opening in said side frame;

each forward column and rearward column having a column width;

said bolster having a first end, a second end, a forward bolster side, and a rearward bolster side;

each of said first and second bolster ends matable with the opening in each side frame defined by the forward and rearward columns;

said forward and rearward columns in facing alignment along said side frame longitudinal axis, with the railcar truck transverse axis centered between the forward and rearward columns at a warp reference position;

said bolster having a bolster longitudinal axis corresponding with the railcar truck transverse axis and generally normal to said truck longitudinal axis and to said side frame longitudinal axes at said warp reference position;

said bolster having a transverse axis parallel to the side frame longitudinal axes at a pitch reference position;

angular displacement of at least one of said side frame longitudinal axes from the warp reference position defining a truck warp angle;

angular displacement of at least one of said side frame longitudinal axes from the pitch reference position defining a pitch angle;

said forward bolster side and rearward bolster side at each of said first and second bolster ends in proximity to a forward column and a rearward column at each said side frame opening;

wherein at least one end of said bolster includes a forward bolster stop surface and a rearward bolster stop surface;

and wherein at least one side frame includes a forward side frame stop surface in a facing relationship with the forward bolster stop surface and a rearward side frame stop surface in a facing relationship with the rearward bolster stop surface;

said forward and rearward side frame stop surfaces and said forward and rearward bolster stop surfaces being in proximity in a horizontal plane at a first vertical level at a first reference spacing to control warp angle;

said forward and rearward side frame stop surfaces and said forward and rearward bolster stop surfaces being in proximity in a horizontal plane at a second vertical level at a second reference spacing to allow for predetermined changes in the pitch angle of the side frame as the railcar truck assembly traverses track with variations in elevation;

said second reference spacing being greater than said first reference spacing.

2. The railcar truck assembly as claimed in claim 1 further comprising a plurality of wear plates, each wear plate having at least one wear surface, at least one of said wear plates secured to each side frame column with said wearing surface facing, respectively, said bolster side in proximity to said column, said wear plate wearing surfaces operable to contact said bolster stop surfaces, wherein said forward and rearward column side frame stop surfaces are on said wear plate wearing surfaces.

3. The railcar truck assembly as claimed in claim 1 further comprising an extension member secured to one bolster side in facing relationship with one side frame stop surface, wherein one of said bolster stop surfaces comprises a surface of said extension member.

4. The railcar truck assembly as claimed in claim 1 wherein the forward bolster side and rearward bolster side have top and bottom edges and wherein at least one bolster stop surface extends from said bottom edge toward said top edge.

5. The railcar truck assembly as claimed in claim 4 wherein said second level of said at least one bolster stop surface is between said first level and said bottom edge of said bolster side.

6. The railcar truck assembly as claimed in claim 1 wherein at least one bolster stop surface is a convex curved surface in cross-section.

7. The railcar truck assembly as claimed in claim 1 wherein at least one bolster stop surface has a warp control portion at said first level and a relief portion at said second level.

8. The railcar truck assembly as claimed in claim 7 wherein the relief portion includes a surface defining a convex curve in vertical cross-section.

9. The railcar truck assembly as claimed in claim 7 wherein the relief portion includes a surface defining a concave curve in cross-section.

10. The railcar truck assembly as claimed in claim 7 wherein the relief portion comprises a planar surface.

11. The railcar truck assembly as claimed in claim 7 wherein the relief portion comprises an undercut.

12. The railcar truck assembly as claimed in claim 7 wherein the warp control portion has one dimension of about 1¾ inches.

13. The railcar truck assembly as claimed in claim 1 wherein at least one bolster stop surface comprises two surfaces lying in intersecting planes.

14. The railcar truck assembly as claimed in claim 1 wherein the second spacing exceeds the first spacing by a distance of at least about ⅜ inch between the forward side frame stop surface and forward bolster stop surface and between the rearward side frame stop surface and rearward bolster stop surface.

15. The railcar truck assembly as claimed in claim 1 wherein the spacing between each side frame stop surface and proximate bolster stop surface at said first level is about ⅜ inch or less.

16. A bolster for use in a railcar truck assembly, the bolster including:

a first end, a second end, a forward side, and a rearward side;

a top wall;

the bolster having a central longitudinal plane centered between the forward side and rearward side;

gibs extending outward from one side of the bolster and a friction shoe pocket between the gibs;

a first bolster stop surface comprising a land between one gib and the friction shoe pocket and a second bolster stop surface comprising a land between the other gib and the friction shoe pocket;

the first bolster stop surface having a warp control portion and a relief portion, the distance between the warp control portion and the central longitudinal plane being greater than the distance between the relief portion and the central longitudinal plane; and the second bolster stop surface having a warp control portion and a relief portion, the distance between the warp control portion and the central longitudinal plane being greater than the distance between the relief portion and the central longitudinal plane;

wherein the warp control portion and relief portion of the first bolster stop surface are aligned along a transverse plane extending perpendicular to the central longitudinal plane and through the top wall of the bolster.

17. The bolster of claim 16 wherein the bolster sides have bottom edges, wherein the bolster stop surfaces are each on one of the bolster sides and the relief portion of each bolster stop surface is between the warp control portion and the bottom edge of the side.

18. The bolster of claim 17 wherein the distance between a plane parallel to the central longitudinal plane of the bolster and through the warp control portion and a parallel plane through the relief portion at the bottom edge is at least about ⅜ inch.

19. The bolster of claim 16 wherein each relief portion converges from the warp control portion toward one side of the bolster.

20. The bolster of claim 16 wherein the warp control portion has one dimension of about 1¾ inches.

21. The bolster of claim 16 wherein the bolster stop surface is a convex curved surface in vertical cross-section that includes both the warp control portion and the relief portion.

22. The bolster of claim 16 wherein each bolster stop warp control portion and relief portion comprise surfaces that lie in intersecting planes.

23. The bolster of claim 16 wherein the bolster stop warp control portion is a planar surface and the relief portion is a surface that is curved in vertical cross-section.

24. The bolster of claim 16 wherein at least one bolster stop surface comprises an extension member removably attached to one bolster side.

25. A railcar truck assembly comprising a bolster and two side frames, said railcar truck assembly having a longitudinal axis and a perpendicular transverse axis, the transverse axis extending the length of the truck bolster;

each side frame having a longitudinal axis, a forward column and a rearward column;

each side frame forward column and rearward column cooperating to define an opening in said side frame;

each forward column and rearward column having a column width;

said bolster having a first end, a second end, a forward bolster side, and a rearward bolster side;

each of said first and second bolster ends matable with the opening in each side frame defined by the forward and rearward columns;

said forward and rearward columns in facing alignment along said side frame longitudinal axis, with the railcar truck transverse axis centered between the forward and rearward columns at a warp reference position;

said bolster having a bolster longitudinal axis corresponding with the railcar truck transverse axis and generally normal to said truck longitudinal axis and to said side frame longitudinal axes at said warp reference position;

said bolster having a transverse axis parallel to the side frame longitudinal axes at a pitch reference position;

angular displacement of at least one of said side frame longitudinal axes from the warp reference position defining a truck warp angle;

angular displacement of at least one of said side frame longitudinal axes from the pitch reference position defining a pitch angle;

said forward bolster side and rearward bolster side at each of said first and second bolster ends in proximity to a forward column and a rearward column at each said side frame opening;

wherein at least one end of said bolster includes a forward bolster stop surface and a rearward bolster stop surface;

and wherein at least one side frame includes a forward side frame stop surface in a facing relationship with the forward bolster stop surface and a rearward side frame stop surface in a facing relationship with the rearward bolster stop surface;

a plurality of said stop surfaces including warp control portions to allow for predetermined changes in the warp angle;

a plurality of said stop surfaces including pitch control portions to allow for predetermined changes in the pitch angle of the side frame as the railcar truck assembly traverses track with variations in elevation;

wherein the maximum pitch angle allowed by said pitch control portions is different from the maximum warp angle allowed by said warp control portions.

26. The railcar truck assembly of claim 25 wherein each stop surface includes a warp control portion and a pitch control portion.

27. The railcar truck assembly of claim 26 wherein each pitch control portion comprises a relief in the surface.

28. The railcar truck assembly of claim 25 wherein the pitch control portions allow a pitch angle of at least 1° and the warp control portions allow a warp angle of less than 1°.

* * * * *